United States Patent [19]

Müntzel et al.

[11] Patent Number: 4,897,222

[45] Date of Patent: Jan. 30, 1990

[54] TRANSPORTABLE PRESS FOR A HIGH CONDENSABILITY OF RADIOACTIVE WASTE MATERIAL OF NUCLEAR POWER STATIONS AND PROCESS FOR CONDENSING THE SAME

[75] Inventors: Wolfgang Müntzel, Barsbüttel; Michael Szukala, Quickborn, both of Fed. Rep. of Germany

[73] Assignee: Firma Hansa Projekt Machinenbau GmbH, Hamburg, Fed. Rep. of Germany

[21] Appl. No.: 616,435

[22] Filed: May 31, 1984

[30] Foreign Application Priority Data

May 31, 1983 [DE] Fed. Rep. of Germany ..... 3319698

[51] Int. Cl.[4] ..... G21F 9/12; G21F 9/24; B30B 15/30; B30B 15/06

[52] U.S. Cl. ..... 252/633; 53/121; 53/523; 53/526; 100/215; 100/229 R; 100/229 A; 100/226; 141/73; 141/80; 264/0.5

[58] Field of Search ..... 252/633, 626; 100/229 R, 229 A, 226, 227, 902, 246, 247, 252

[56] References Cited

U.S. PATENT DOCUMENTS

| | | | |
|---|---|---|---|
| 1,203,288 | 10/1916 | Webster | 100/247 |
| 1,250,558 | 12/1917 | Burns | 100/247 |
| 3,945,314 | 3/1976 | Hennells | 100/229 A |
| 4,008,658 | 2/1977 | Stock et al. | 100/229 A |
| 4,056,053 | 11/1977 | Akerberg | 100/229 A |
| 4,099,363 | 7/1978 | Wistinghausen et al. | 100/226 |
| 4,324,176 | 4/1982 | McCormick | 100/229 R |
| 4,524,048 | 6/1985 | Schmidt et al. | 252/626 |

*Primary Examiner*—Howard J. Locker
*Attorney, Agent, or Firm*—Michael J. Striker

[57] ABSTRACT

A hydraulically operated transportable press for compressing radioactive waste materials collected within containers includes a matrix formed of two closable and openable cups receiving a waste collecting container and a stamp actuated to compress the waste within and together with the container into a small package removable from the press.

13 Claims, 3 Drawing Sheets

TRANSPORTABLE PRESS FOR A HIGH CONDENSABILITY OF RADIOACTIVE WASTE MATERIAL OF NUCLEAR POWER STATIONS AND PROCESS FOR CONDENSING THE SAME

BACKGROUND OF THE INVENTION

The present invention relates to a transportable press for a high condensability of radioactive or slightly contaminated waste material from nuclear power stations, which materials are condensed in a collective container with the matrix of the press into a condensed package by means of a stamp.

In operation of a nuclear power station there is a regular amount of radioactive contaminated waste material which must be removed from the plant under particular protective measures. This includes, for example, plastic foils as well as cleaning materials and the cloth of the operating personnel, their shoes, protective shoes and the like. These waste materials are collected in collective containers, whereby about 1,000 barrels are accumulated in a nuclear power station during a given year. In order to remove these waste materials with a possible economical effort, these filled collecting containers are condensed by means of a special press under a very high pressure of hitherto about 1.600 megapond (Mp). The condensed packages are collected in small numbers in other collecting containers which can then be hauled away.

Customarily, waste material is not condensed with such high pressures, because it requires a great effort. However, in the nuclear industry the expenses per end provision per unit volume are so high that it is profitable to operate with the above mentioned particularly high pressures, so as to obtain a very low volume of the above condensed waste material to be hauled away.

With respect to the considerable expenses incurred for removing radiation waste materials it is generally practicable to provide a number of nuclear power plants with one press which can be ordered on request and which is operated at the nuclear power station in question. The known press is provided with a horizontal matrix and a horizontal pressure stamp having a piston rod. This piston rod is mounted on a yoke which is connected with four cylinders. A counter pressure plate is provided adjustable in height at the end of the matrix for providing a counter pressure during the pressing operation. During the operation of this device, the container to be compressed is at first moved into the device, before starting the condensing operation, from above into a chamber which is located between the matrix and the stamp. Thereafter, the barrel or the container is fed into the matrix and is pushed against the counter pressure plate. The counter pressure plate is lifted after the pressing operation, so that the stamp can horizontally move out the condensed package. Such a press is of a considerable construction length. Hence, the known press is so large in its size that it can only be transported on special vehicles, like flat beds when hauling it on the roads to its destination. This is very expensive. Furthermore, expensive measures must be taken in order to protect the environment from radioactivity when moving the known press from one site to another, which may be caused by the press itself due to the contact with the waste materials. Therefore, the known press must be subjected to expensive cleansing before being moved and it is common to encompass the press which a sheath of plastic before moving.

A further constructive expense related to the known press is caused by the circumstance that it is provided with four piston roads which act on a common yoke.

SUMMARY OF THE INVENTION

It is therefore an object of the invention to provide a transportable press for a high condensability of radioactive waste material which requires a considerably less operating effort with higher capacity volumes and which offers the possibility to transport it on commercially available vehicles in public traffic due to its reduced dimensions and its high capacity, so that it does not require special vehicles for its transport and the closing of the transport path while being enroute. In accordance with the invention it is provided that the matrix of the press consists of two pivotable semicylindrical cups which are vertically disposed during operation and which are connected to each other by a swivel joint, whereby the cups are provided with a locking mechanism for the locking position and that the height adjustable stamp is disposed above the matrix.

A press in accordance with the invention operates in an upstanding position with a relative low construction height and does not require a chamber for storing collective containers between the matrix and the moved out stamp, since the collective container can be fed from the side while the matrix is open. On the other hand, there is a construction height which renders the press in the operating position unsuitable for transport. Therefore, the design of the invention is such that the press is provided with pivots mounted in supports being pivotable around a lateral axis from a horizontal transport position into a vertical operating position, or vice versa, from its vertical operation position into a horizontal transport position for transporting purposes and from which it could then be placed onto a commercially available container, so that no special protective measures of the type of a plastic sheathing is required.

A particular low construction height or transport length is obtained by the feature in that the matrix supports on a bottom plate which is braced by pole like pulling rods with a counter pressure plate which immediately supports the pressure cylinder with the stamp.

Further features of the invention are obvious from the claims and the following description of one of the embodiments which is also shown in the drawing.

DETAILED DESCRIPTION OF THE PREFERRED EMBODIMENTS

Figure 1:
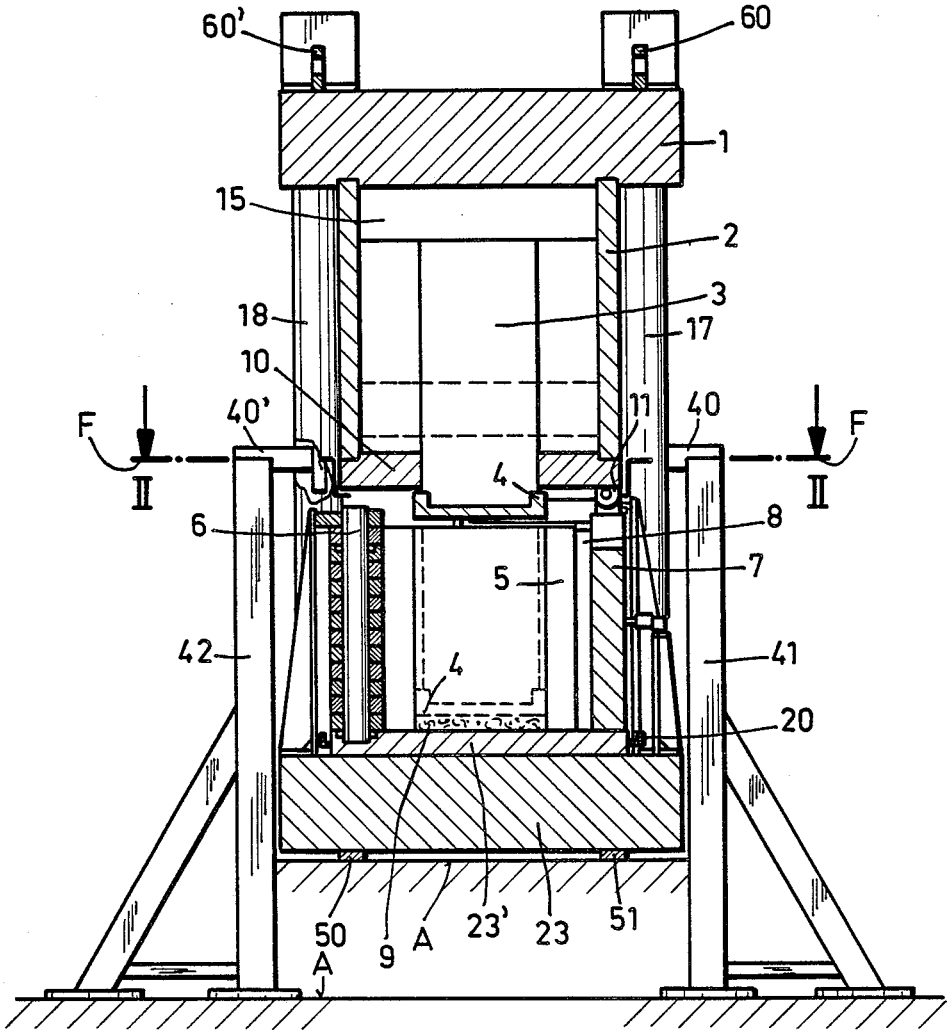
FIG. 1 is a press in a longitudinal section with a mounting in support blocks.

The press illustrated in the drawing for a high condensability of radioactive wastes below a pressure of about 2,400 megapond is provided with a counter pressure plate which supports a pressure cylinder 2 on its lower side. The stamp is positioned within the pressure cylinder 2 consisting of a piston rod 3 as well as a piston 15 and a stamp pressure plate 4. The stamp pressure plate 4 has a larger diameter than that of the piston rod 3 and is detachably mounted thereon, so that it can be replaced after a partial wear without reworking the whole piston rod 3.

The matrix is positioned below the stamp pressure plate 4 at the uppermost dead center position in accordance with the shaded illustration in FIG. 1, and consists of two pivotable semispherical cups 5 and 5' also seen in FIG. 2. These two cups 5 and 5' are pivotably connected with each other by a swivel joint 6. They can be locked in the closed operating position by means of a height adjustable locking block 7 which is provided with a recess 7'. As seen from FIG. 2, this recess 7' is conically cut in its height and is dovetail like in its cross section, so that it encompasses a tapered sleeve 8 of the two cups 5 and 5' in the locking position, thus locking the matrix in place, while only a slight lifting of the locking block 7 is required for releasing the tapered sleeve 8. This lifting is performed by two cylinders 11 and 11' which guide the locking block 7.

Figure 2:
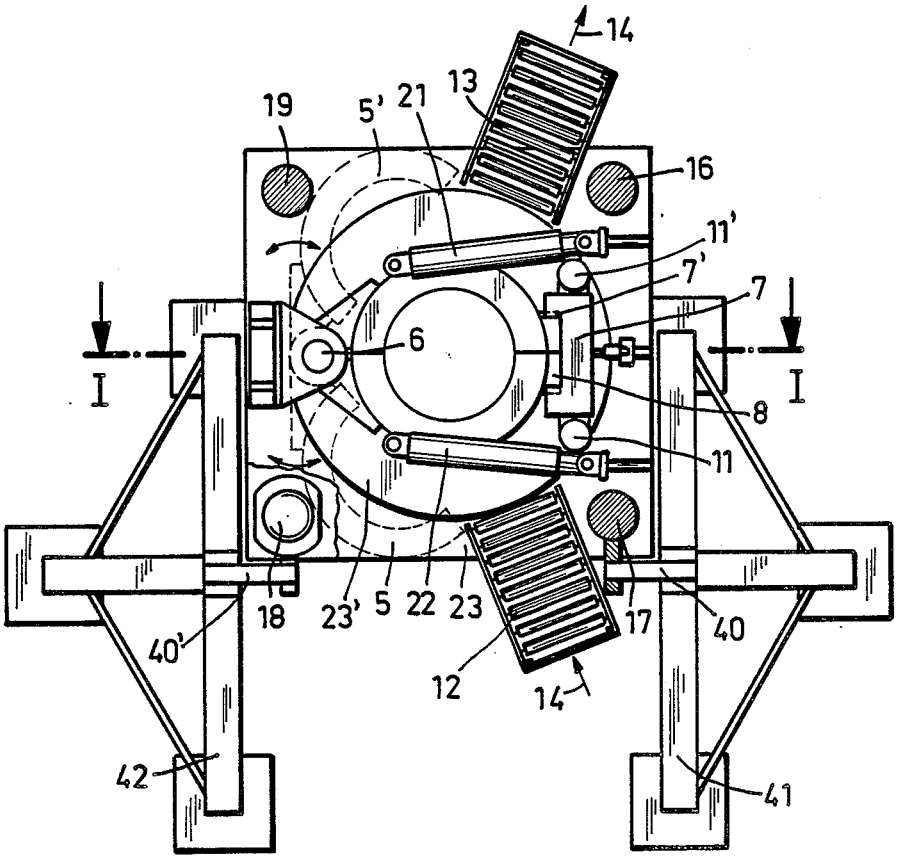
FIG. 2 is a transverse sectional view along line II—II of FIG. 1.

As shown in FIG. 2, two hydraulic setting cylinders 21 and 22 are provided for opening and closing the matrix, whereby one of each engages one of the cups 5, 5', thus placing them into an opening position shown in dashed lines in FIG. 2.

Figure 3:
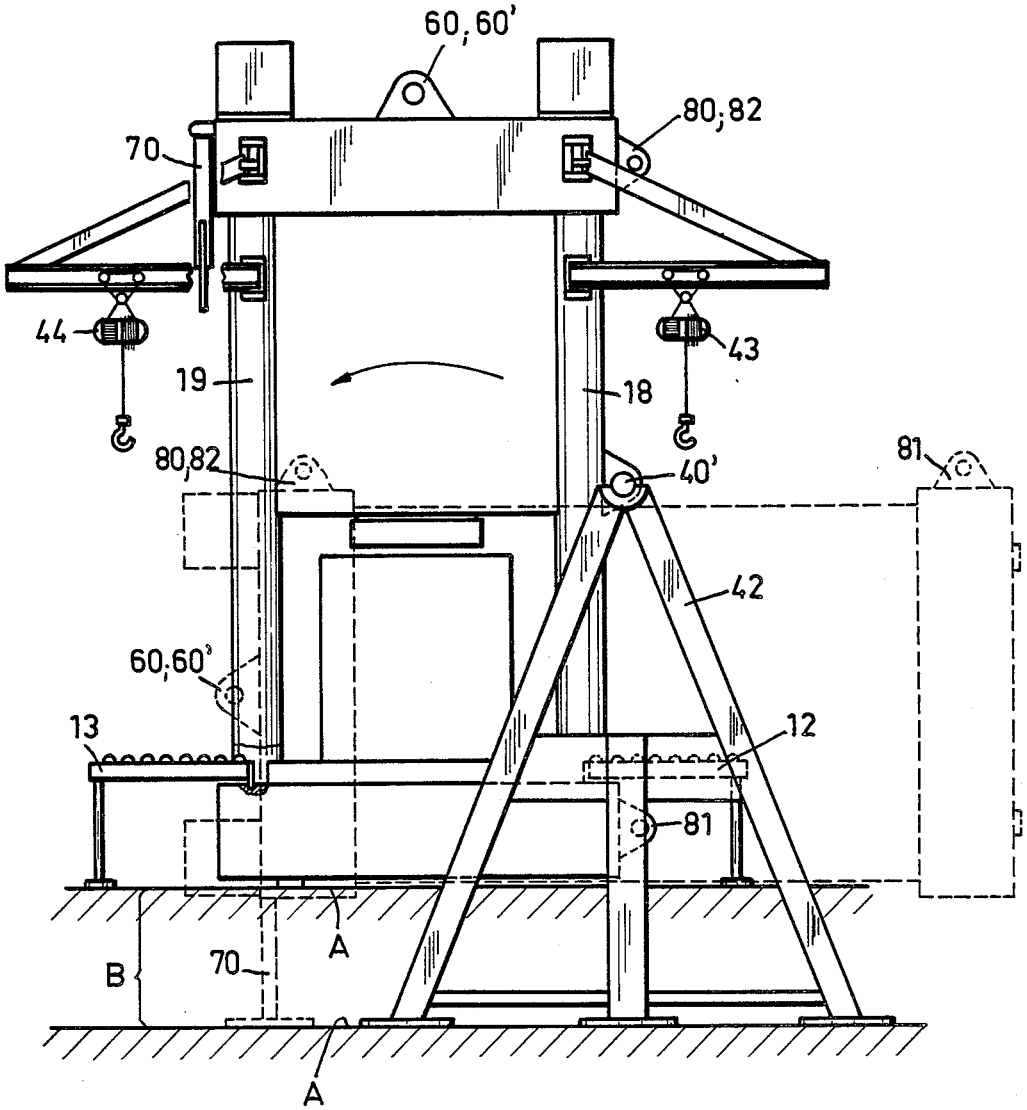
FIG. 3 is a side view of the press in operating position and transport position.

When the cups 5 and 5' of the matrix are in an open position, a collecting container filled with waste material can be introduced over a conveyor belt 12 in the direction of arrow 14 radially into the opening of the matrix. Thereby an overhead crane 43 or 44 can be used as illustrated in FIG. 3 which cranes are mounted on a pivotable support arm 90 or 92 respectively. The condensed package within the matrix can also be moved with the assistance of the overhead crane onto a second conveyor belt 13 and can be removed therefrom in a radial direction in accordance with arrow 14'.

After closing and locking the matrix, the control for the stamp is released, so that the same can be moved into the matrix. Thereby, the stamp moves to a capacity limit of about 450 Mp. After reaching this value the stamp moves further with a reduced speed until reaching a capacity of about 2,000 Mp. However, it should be noted that the maximum capacity can indeed be larger. Thereby, the container is, as condensed into a package 9 which is illustrated in FIG. 1, positioned on the bottom of the matrix.

After the condensing process the stamp rapidly returns to its upper dead center point position which is shown in solid lines in FIG. 1. Thereby, the piston rod 3 is fed in a bore of cylinder bottom 10. The switching of the stamp moving speeds and the transmissions of the hydraulic pumps into a pressureless cycle are automatically controlled by the hydraulic system in conjunction with known means.

As seen in FIG. 1, the matrix is supported by a bottom plate 23 which in turn supports another plate 23' which is connected with a collection line 20 wherein the liquids pressed out during the pressing of the waste materials are collected and removed.

The bottom plate 23 is connected with the counter pressure plate 1 by means of four post like pulling rods 16,17,18 and 19. Of these pulling rods or post rods the pulling rods 17 and 18 each carry one pivoting pin 40 or 40' coaxially arranged with respect to the respective pulling rod and extending transversely from the base plate 10 and the counter pressure plate 1. The press is pivotably mounted by means of pivot pins 40 and 40' in two mounting blocks 41 and 42 shown in FIG. 2. Such a mounting is of an essential advantage, because it enables the press to be pivoted into a horizontal position for transporting to the site of use. This so-called transport position is shown in dotted lines in FIG. 3.

The press is resting on feet 50 and 51 (FIG. 1) during its operation, thus supporting on bottom surface A. The press is lifted for transporting purposes by means of supporting eyelets 60 or 60' which are mounted on the counter pressure plate 1. Subsequently, the press is lowered and mounted with their swivel pins 40 and 40' in the receiving bearings of the two supports 41 and 42. For this purpose a lifting by the distance B in accordance with FIG. 3 is required. Thereafter, the press can be pivoted into the horizontal transport position. In this transport position the press is able to support itself by means of a support leg 70 which is pivotably mounted at one side of the press. At the sides of the press at least three further eyelets 80,81 and 82 are provided for moving the press in the horizontal transport position.

It will be understood that each of the elements described above, or two or more together, may also find a useful application in other types of transportable presses differing from the types described above.

While the invention has been illustrated and described as embodied in a transportable press for transporting radioactive waste material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A transportable hydraulic press for condensing radioactive waste materials of high condensability, produced in nuclear power plants, the press comprising a matrix for receiving a container with waste material therein; a hydraulically operated stamp for pressing said container, said matrix including two cups pivotally connected to each other and pivotable between an open position in which said container is received in said matrix and a closed position in which said container is pressed upon; locking means for locking said cups in said closed position; two hydraulic setting cylinders each connected to a respective cup to pivot the same between the open and closed position, said press being movable from a vertical operative position to a horizontal transportable and inoperative position, said cups being vertically disposed in said operative position, said stamp being operated to press the waste material in said container together with said container into a package of a smaller height; means for radially loading containers containing said waste material onto said matrix; and means for radially removing said package from said matrix.

2. The press as defined in claim 1; further including support blocks, said press having laterally protruding pivot pins supported in said support blocks, respectively, so that the press can be pivoted from said vertical operative position to said horizontal transportable position.

3. The press as defined in claim 2, wherein said pivot pins are mounted at two sides of the press coaxially with each other.

4. The press as defined in claim 1, further including a bottom plate supporting the container being pressed, a counter pressure plate supporting said stamp which includes a stamp pressure plate, a pressure cylinder and a piston rod actuating said stamp pressure plate, and pulling rods extending between said bottom plate and said counter pressure plate.

5. The press as defined in claim 4, further including a liquid waste collecting line mounted in said bottom plate below said matrix.

6. The press as defined in claim 1, further including at least one pivotable supporting leg for supporting the press in said vertical position.

7. The press as defined in claim 1, further including supporting eyelets at an upper side and at a lateral side of the press.

8. The press as defined in claim 4, wherein said stamp pressure plate has a larger diameter than said piston rod.

9. The press as defined in claim 1, wherein said loading means includes a conveyor belt connected to said matrix.

10. The press as defined in claim 1, wherein said removing means includes a conveyor belt connected to said matrix.

11. The press as defined in claim 1, wherein said locking means includes a locking block having a conical dovetail-shaped recess, each of said cups having a taper engageable in said recess.

12. The press as defined in claim 1, wherein said cups are semi-cylindrical.

13. A process of condensing radioactive waste material of high condensability, produced in nuclear power plants by condensing said material into a package in a waste collecting container within a matrix of a press by means of a stamp under a high pressure, the process comprising the steps of providing a matrix of two openable and closable cups for receiving the waste collecting container, placing the press to a vertical operative position, moving the container into said matrix, closing the matrix, locking said matrix in a closed position, and compressing waste material together with said container by said stamp into a package of a smaller height, opening the matrix, and removing said package therefrom, wherein the press is pivoted from said vertical operating position after use into a horizontal transport position.

* * * * *